US005596265A

United States Patent [19]

Wrathall et al.

[11] Patent Number: 5,596,265

[45] Date of Patent: Jan. 21, 1997

[54] BAND GAP VOLTAGE COMPENSATION CIRCUIT

[75] Inventors: Robert S. Wrathall, Scotts Valley; Steven J. Franck, Felton, both of Calif.

[73] Assignee: Siliconix incorporated, Santa Clara, Calif.

[21] Appl. No.: 388,535

[22] Filed: Feb. 14, 1995

Related U.S. Application Data

[62] Division of Ser. No. 326,408, Oct. 20, 1994, Pat. No. 5,559,424.

[51] Int. Cl.[6] ..... G05F 3/16; G05F 3/20

[52] U.S. Cl. ..... 323/315; 323/316; 323/907; 327/539

[58] Field of Search ..... 323/313, 315, 323/316, 907; 327/539

[56] References Cited

U.S. PATENT DOCUMENTS

| | | | |
|---|---|---|---|
| 4,277,739 | 7/1981 | Priel | 323/313 |
| 4,456,872 | 6/1984 | Froeschle | 323/286 |
| 4,631,653 | 12/1986 | Small | 363/17 |
| 4,645,999 | 2/1987 | Szepesi | 323/315 |
| 4,733,162 | 3/1988 | Haga et al. | 323/316 |
| 5,013,934 | 5/1991 | Hobrecht et al. | 323/313 |
| 5,083,079 | 1/1992 | Plants | 323/313 |
| 5,091,689 | 2/1992 | Katao | 323/312 |
| 5,132,556 | 7/1992 | Cheng | 323/315 |
| 5,157,322 | 10/1992 | Llewellyn | 323/315 |
| 5,264,784 | 11/1993 | Ortiz | 323/315 |
| 5,311,146 | 5/1994 | Brannon et al. | 330/288 |
| 5,359,277 | 10/1994 | Cowett, Jr. | 323/207 |

*Primary Examiner*—Peter S. Wong
*Assistant Examiner*—Shawn Riley
*Attorney, Agent, or Firm*—Skjerven Morrill MacPherson Franklin and Friel; Brian D. Ogonowsky

[57] ABSTRACT

The preferred embodiment voltage regulator exhibits improved stability by offsetting changes in the output impedance of the regulator due to changes in load current. This compensation occurs virtually instantaneously with a change in load current. This enables an output capacitor to be selected primarily based upon filtering requirements rather than on frequency compensation requirements. Also in the preferred embodiment, a depletion mode pass transistor is used as the output transistor. A PMOS transistor on/off switch is connected between the source of the pass transistor and the output terminal of the regulator to effectively turn the regulator on or off without shutting down the depletion mode pass transistor. This avoids the need to form a negative supply voltage generator. An improved band gap voltage reference generator is also described which introduces a beta correction factor into the output voltage which offsets changes in beta due to process variations and other conditions. Thus, the output voltage of the reference generator is not affected by variations in the beta of transistors forming the reference generator.

10 Claims, 16 Drawing Sheets

A BODE PLOT OF THE REGULATOR AMPLIFIER STAGE

RESPONSE TO 100mA CURRENT STEPS ON A CURRENT RAMP

KEY TO

| | | |
|---|---|---|
| FIG. 8A | FIG. 8B | FIG. 8C |
| FIG. 8D | FIG. 8E | FIG. 8F |
| FIG. 8G | FIG. 8H | FIG. 8I |

VPLUS
bref
VPLUS
VP
IC
JREF
U1
JR
01
V1_2
V4_7
V5
VCL
E
VN
TRIM(1:4)
20
IC
JREF
JR
01
V1_2
V4_7
V5
VCL
WI
bias
VP
I1
I2
I4
I5
I6
JREF
VCL
IR
J1
J2
J3
J4
VN
D2
IOSC
ZOUT
OT
E
IR
C
D
PB
IB
28
GND
PLUS1
PLUS2
LESS4
V5
P5
RS
PLUS1
PLUS2
LESS4
trimlog
TRIM(1:4)
TRIM(1:4)
VN
U10
68

KEY TO

BAND GAP VOLTAGE COMPENSATION CIRCUIT

This application is a division of application Ser. No. 08/326,408, filed Oct. 20, 1994, now U.S. Pat. No. 5,559, 424.

FIELD OF THE INVENTION

This invention relates to voltage regulators, and in particular to an improved output stage of a voltage regulator.

BACKGROUND OF THE INVENTION

FIG. 1 is a block diagram illustrating the general configuration of a linear-type voltage regulator whose output voltage $V_{out}$ is regulated using a feedback loop. A battery or other unregulated power supply voltage V+ is applied to an input terminal of an output amplifier 10. Output amplifier 10 includes a pass transistor connected between V+ and $V_{out}$. A resistor-divided output voltage $V_{out}$ is fed back into an error amplifier 2, and this feedback voltage is compared to a reference voltage generated by a reference voltage generator 14. The error amplifier 2 generates an error signal which controls the pass transistor in output amplifier 10 to have a conductivity such that the divided $V_{out}$ voltage matches the reference voltage despite changes in load current.

Output capacitor C is used for both filtering $V_{out}$ and for frequency compensation to improve the stability of the circuit when transients are created at the $V_{out}$ terminal. Such transients may be created by varying load conditions. As would be understood by those skilled in the art, the proper selection of the output capacitor C value is dependent upon the impedance of the pass transistor in output amplifier 10.

The impedance of the pass transistor (and thus the output impedance of the regulator) changes as the load current varies. This impedance change can occur even before the feedback circuit reacts to the changed load condition. For example, if the pass transistor were an MOS device having its source coupled to $V_{out}$ or if the pass transistor were a bipolar transistor having its emitter coupled to $V_{out}$, a sudden drop in load resistance would reduce the source or emitter voltage and instantaneously increase the $V_{GS}$ or $V_{BE}$ of the pass transistor. This, in turn, decreases the output impedance of the regulator.

Conversely, the output impedance increases when less current is drawn through the load.

This change in output impedance affects the frequency compensation requirements, and the designer must select a value of capacitor C taking this into account. Thus, the capacitor value is selected with worse case conditions in mind.

What is needed is a circuit and method for improving the compensation of a voltage regulator output.

In many types of low dropout voltage regulators, a high voltage depletion mode NMOS device is used as the pass element in output amplifier 10. If it were desired to turn the voltage regulator off, the gate of the depletion mode NMOS device must then be driven to a voltage below its source, which usually means that a negative voltage supply is required to pull the gate below ground. Creating a negative voltage source requires additional complexity and silicon real estate.

What is needed is a circuit and method to turn off a voltage regulator having a depletion mode pass transistor without requiring the creation of a negative voltage supply.

The reference voltage generator 14 in FIG. 1 is typically a band gap reference type, whose characteristics are well known. Band gap voltage generators produce a relatively constant voltage over a range of temperatures by combining a voltage having a positive temperature coefficient with a voltage having a negative temperature coefficient. These voltages are related to the $V_{BE}$ of bipolar transistors used in the reference voltage generator and are affected by process variations.

The typical band gap reference will have a voltage verses temperature characteristic that peaks at some nominal temperature and decreases in voltage as temperature is increased above or decreased below this nominal temperature. This decrease lowers the reference voltage by a small amount (e.g., up to 5 mV). Part of this decrease is proportional to (kT/q) in (beta), where beta is the current gain of the bipolar transistors used in the reference voltage generator.

It is important that the reference voltage remain relatively constant throughout a wide range of temperatures and be predictable despite process variations since the ability of the voltage regulator of FIG. 1 to output a constant $V_{out}$ is directly dependent upon the ability of the reference voltage generator 14 to output a constant reference voltage.

Thus, what is needed is a reference voltage generator whose output is less affected by process dependent beta variations and temperature variations.

SUMMARY OF THE INVENTION

The preferred embodiment voltage regulator exhibits improved stability by offsetting changes in the output impedance of the regulator due to changes in load current. This compensation occurs virtually instantaneously with a change in load current. This enables an output capacitor to be selected primarily based upon filtering requirements rather than on frequency compensation requirements.

In the preferred embodiment, a depletion mode pass: transistor is used as the output transistor. In prior circuits, a negative voltage supply was required to pull the gate of the depletion mode device below the source voltage in order to completely turn off the pass transistor. In the preferred circuit, a PMOS transistor on/off switch is connected between the source of the pass transistor and the output terminal of the regulator to effectively turn the-regulator on or off without shutting down the depletion mode pass transistor. This avoids the need to form a negative supply voltage generator.

An improved band gap voltage reference generator is also described which introduces a beta correction factor into the output voltage which offsets changes in beta due to process variations and other conditions. Thus, the output voltage of the reference generator is not affected by variations in the beta of transistors forming the reference generator.

DETAILED DESCRIPTION OF THE PREFERRED EMBODIMENT

Figure 1:
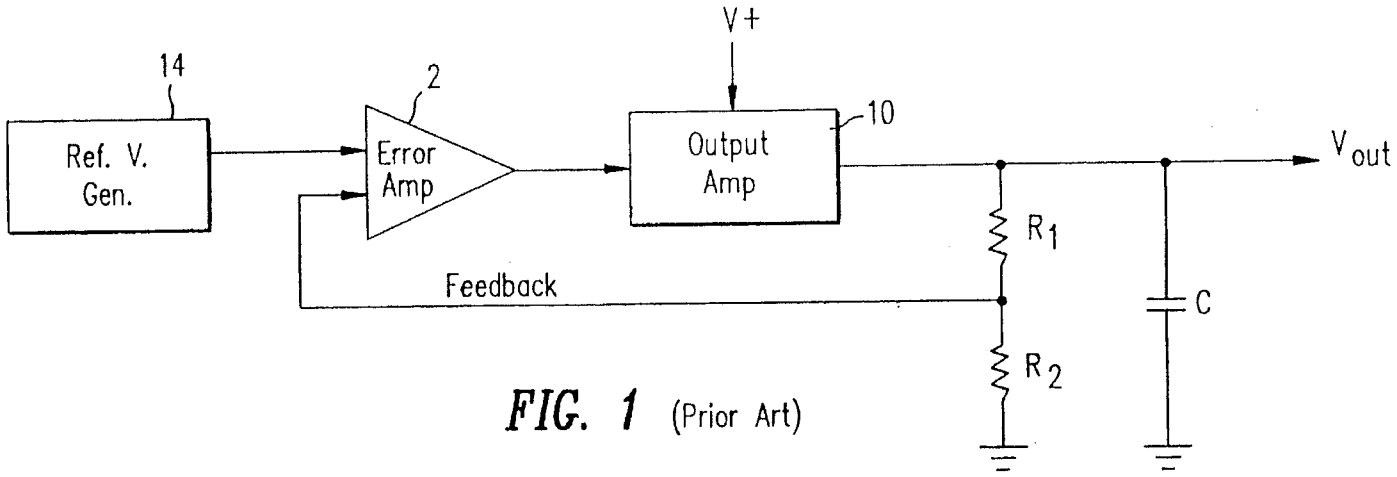
FIG. 1 (Prior Art)
FIG. 1 illustrates a prior art voltage generator.
Figure 2:
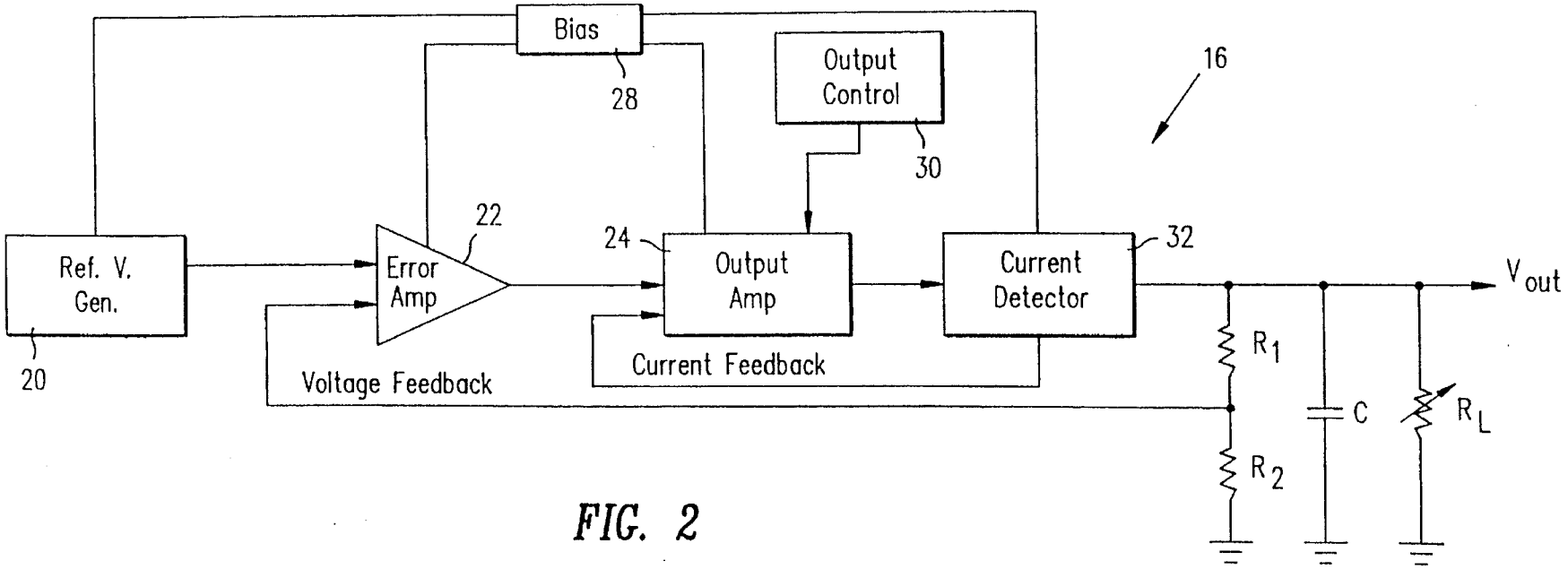
FIG. 2 illustrates one embodiment of the voltage generator in accordance with the present invention.

FIG. 2 illustrates one embodiment of a voltage regulator 16 incorporating the inventive circuits. Portions of the voltage regulator which may be conventional will not be described herein in detail.

In FIG. 2, reference voltage generator 20 provides a stable reference voltage despite changes in temperature. This reference voltage, which is about 1.25 volts in one embodiment, is compared by an error amplifier 22 to a voltage, taken at the junction of resistors R1 and R2, related to the output voltage $V_{out}$. The resistor divider is not needed if a gain stage is used at the output of the reference voltage generator to output the desired $V_{out}$ voltage. The error signal is applied to an output amplifier 24 for controlling a pass transistor to supply more or less current to a load ($R_L$) to keep $V_{out}$ constant despite changes in $R_L$, Output control circuit 30 controls the output amplifier 24 to be on or off and provides a current limiting function.

A current detector 32 detects an output current of the pass transistor and applies a feedback signal, related to the current, to the elements controlling the pass transistor. The current detector 32 and feedback circuitry operate rapidly to cause the impedance of the pass transistor to not substantially change with rapid fluctuations of the load $R_L$.

A bias circuit 28 provides various bias voltages to the circuitry in blocks 20, 22, 24, and 32.

Capacitor C provides filtering and frequency compensation to improve the stability of the regulator in response to transient conditions at $V_{out}$. The feedback provided by the current detector 32 to stabilize the output impedance of the regulator enables the designer to select the value of capacitor C based primarily upon the filtering requirements rather than on frequency compensation requirements.

Figure 3:
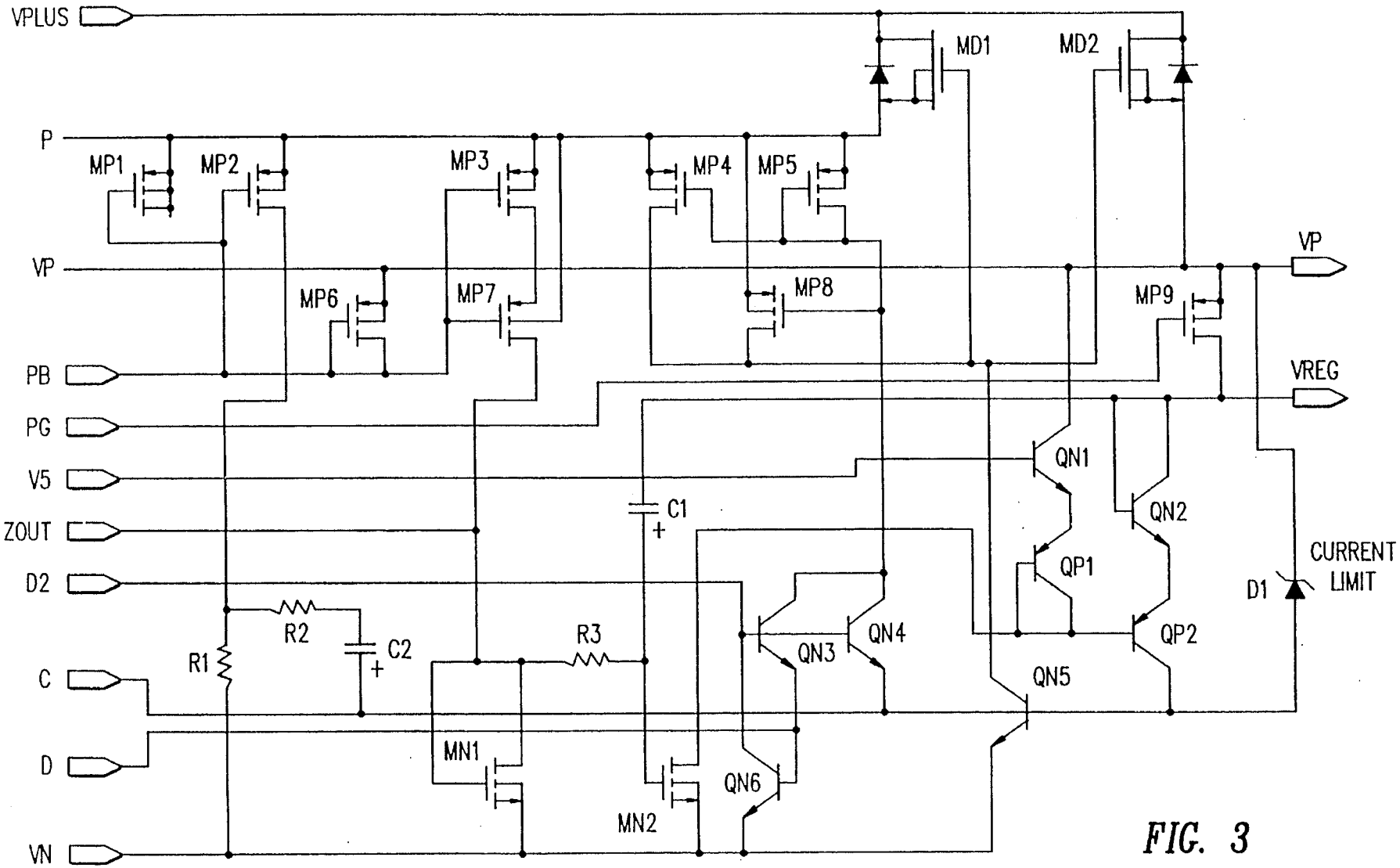
FIG. 3 is a schematic diagram of the error amplifier, output amplifier circuitry, current detection circuitry, and current feedback circuitry shown in FIG. 2

FIG. 3 is a schematic diagram of error amplifier 22, output amplifier 24, and current detector 32, along with some biasing and output control circuitry, in accordance with the preferred embodiment voltage regulator.

NMOS transistor MD2 is a high voltage/high current depletion mode transistor, acting as a pass transistor, having a drain connected to a positive power supply terminal VPLUS. VPLUS may be an automobile battery or another voltage source generating up to 60 volts. The gate of transistor MD2 is controlled to supply a current through PMOS transistor MP9 such that the output voltage at the output VREG of the voltage regulator remains at 5 volts despite the changing current needs of a load (not shown) connected between VREG and ground. Transistor MP9 acts as an on/off switch and receives either a high signal or a low signal at its gate, via terminal PG, for connecting the source of transistor MD2 to the VREG terminal. By controlling the on/off state of PMOS transistor MP9, the output voltage at VREG is turned on or off without having to turn off depletion mode transistor MD2. This avoids the need for a negative voltage supply to apply a negative voltage to the gate of transistor MD2 to turn off transistor MD2. This results in a considerable savings of silicon area and complexity. PMOS transistor MP9 may be a 5 volt device.

Other types of suitable switches may be substituted for transistor MP9.

A 5 volt reference voltage, generated by an amplified output of a band gap reference generator (to be described later), is applied to input terminal V5 and applied to the input of bipolar transistor QN1. The voltage drops across bipolar transistors QN1, QP1, QP2, and QN2 are maintained such that the output voltage at VREG is the same voltage as applied to pin V5. The $V_{GS}$ of pass transistor MD2 is automatically adjusted up or down to cause the voltage drops across QN1 and QP1 to equal the voltage drops across QN2 and QP2. This then balances the transistor bridge and causes the voltage at VREG to be at 5 volts.

Depending on the matching of voltage drops across the transistor bridge, the gate voltage of transistor MD2 is either pulled down by transistor QN5 or pulled up by transistor QN4 controlling MOS transistors MP4, MP5, and MP8 to pull up the gate of transistor MD2 to the source voltage of NMOS transistor MD1. Other types of push/pull stages may also be used. Using transistor MD1 to power the gate drive circuitry for transistor MD2 allows the gate of transistor MD2 to be raised nearly 1 volt above the source of transistor MD2 at high currents, providing an increased maximum output current for the regulator.

A fixed bias current is applied to input terminals C, D, and D2. The VN terminal is connected to ground. The PB terminal is connected to a bias voltage to cause transistors MN1, MP3, and MP7 to properly bias transistor MN2 and the transistor bridge. Current flowing into terminal Zout can be used for adjusting the gain of the error amplifier.

Compensating the output stage is accomplished with two capacitors, C1 and C2. The main gain roll-off capacitor is C2. The dominant parasitic pole in the circuit is generated by the gate of the pass transistor MD2 and the output impedance of the push-pull amplifier. If the pole due to a load capacitor connected to VREG occurs while the gain of the circuit is greater than one, oscillations will occur. Capacitor C1 is introduced as a zero in the circuit to cancel out the dominant parasitic pole. The effect of C1 is to lower the output impedance of the regulator. Capacitor C1 is a pole cancellation capacitor to extend the operating range to lower values of output capacitance. Typically, the poles of the load capacitance will be on the order of hundreds of kilohertz.

The compensation capacitance C2 is placed in the current loop of the amplifier. Changes in output current are slowed by the operation of this capacitor C2. Further, a zero is introduced into this circuit by the operation of resistors R1 and R2.

A portion of the circuit of FIG. 3 which is used to improve the stability of the regulator by offsetting changes in output impedance due to transients at the VREG terminal will now be described.

The feedback loop which compares the reference voltage at terminal V5 to the voltage at VREG and adjusts the gate voltage of transistor MD2 is relatively slow and does not react to high frequency transients at the VREG terminal. These transients change the conductivity of transistor MD2, making compensation difficult. Without proper compensation, the regulator may be unstable in response to these transients. In order to maintain the output impedance of the voltage regulator relatively constant despite transients on VREG, a fast feedback loop is provided primarily consisting of depletion mode transistor MD1, PMOS transistors MP6 and MP2, resistors R1 and R2, capacitor C2, and bipolar transistor QN5. This feedback loop reacts to the current through transistor MD2 rather than voltage fluctuations at the VREG terminal.

Since MOS devices are square law devices, if the threshold voltage of pass transistor MD2 is subtracted from its $V_{out}$ voltage, this resulting voltage is proportional to the square root of the current through transistor MD2. The difference between nodes VP and P in FIG. 3 represents this voltage. A PMOS threshold is added by the operation of transistor MP6. The $V_{GS}$ of PMOS transistor MP2 generates a current proportional to the current through pass transistor MD2, and a voltage proportional to this current is generated across R1. This voltage at resistor R1 is then used to generate the compensation gate voltage for pass transistor MD2. This scheme allows the amplifier to anticipate overshoot in the load by slowing changes in current under conditions which generate high rates of change of current such as step loads and startups.

Figure 4:
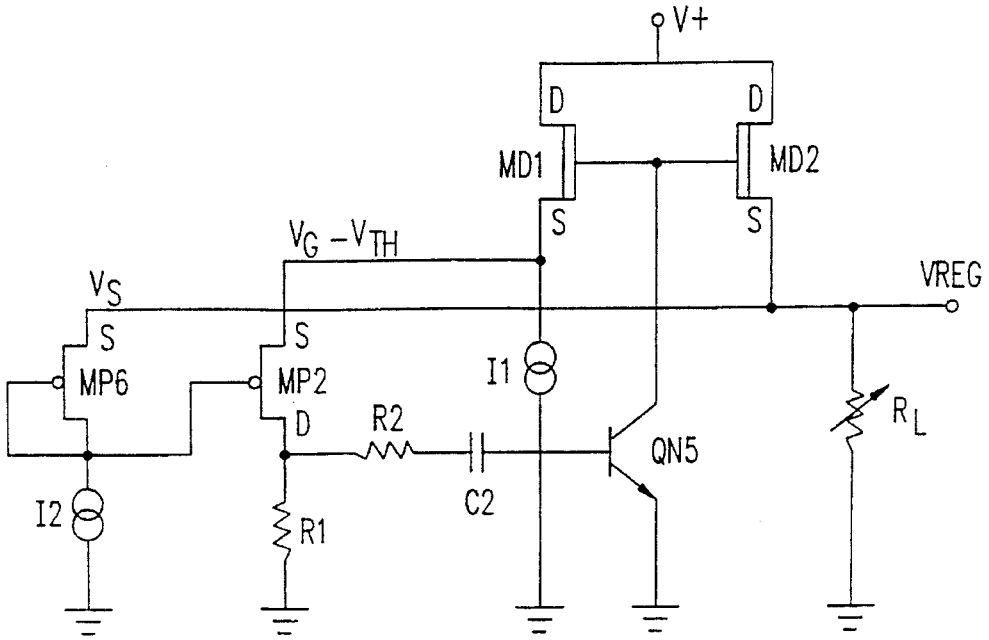
FIG. 4 is a simplified schematic diagram of the pertinent portions of FIG. 3.

A simplified version of this fast feedback loop portion of FIG. 3 is shown in FIG. 4. The current source I1 connected to the source of transistor MD1 is formed in part by PMOS transistors MP3 and MP7 in conjunction with NMOS transistor MN1 in FIG. 3. A second current source I2 shown in FIG. 4 is provided by a bias circuit (not shown) connected to terminal PB in FIG. 3.

Transistors MD1 and MD2 are similar depletion mode NMOS transistors except that MD1 is much smaller than MD2 and hence carries a low current and provides a low voltage drop. Transistors MD1 and MD2 have their gates connected together so that the current through transistor MD1 somewhat tracks the current through MD2.

The voltage at the source of transistor MD1 reflects the gate voltage of transistor MD2 minus the threshold voltage of transistor MD2 (the $V_{TH}$ of MD1 and MD2 are equal) at a given instant. This $V_G-V_{TH}$ voltage is applied at the source of transistor MP2.

The source of transistor MD2 is connected to the source of transistor MP6. The gate and drain of MP6 are connected together so that the voltage drop (i.e., a threshold voltage) across transistor MP6 is constant. The voltage at the drain of transistor MP6 is coupled to the gate of transistor MP2 so that the $V_{GS}$ of transistor MP2 is related to the $V_{GS}-V_{TH}$ of transistor MD2. Thus, the current through transistor MP2 will track the current through transistor MD2.

The current through transistor MP2 is reflected as a voltage drop across resistor R1, where an increased current through MP2 (or MD2) raises the voltage at resistor R1. This voltage is coupled to the base of NPN bipolar transistor QN5, via resistor R2 and capacitor C2. Transistor QN5 is coupled between the common gate of MD1 and MD2 and ground such that an increased voltage at resistor R1 lowers the gate voltage of transistor MD2. This, in turn, quickly lowers the current through transistor MD2 in response to an increase in load current. Conversely, a drop in load current causes the gate voltage of transistor MD2 to be raised accordingly.

As an example, if the load connected to the VREG terminal attempts to draw more current, the source of transistor MD2 will be pulled down. This would normally raise the $V_{GS}$ of MD2 and thus rapidly decrease the output impedance of the voltage regulator. In response, transistor MP2, in conjunction with resistor R1 and transistor QN5, pulls down the gate of transistor MD2 so that the resulting $V_{GS}$ of MD2 will remain relatively constant even in light of this fast transient on the VREG terminal.

The voltage at resistor R1 is also coupled to the emitter of transistor QN4, comprising part of the gate pull-up circuitry. If the voltage at resistor R1 were to decrease, then the gate of transistor MD2 would be pulled up to achieve a constant $V_{GS}$.

Transistor MP1 in FIG. 3 provides a capacitance across transistor MP2 to improve stability.

Diode D1 conducts when the voltage at terminal VP exceeds a certain level in order to limit voltage excursions on VREG. This conduction of diode D1 turns on transistor QN5 to pull the gate of transistor MD2 low.

As seen, this fast feedback circuit provides current feedback compensation rather than output voltage compensation in response to a transient on the VREG terminal.

This unique compensation scheme incorporating the fast feedback loop makes the output stage stable into almost any capacitive or resistive load by design from 0.1 microfarads to 100 microfarads and nearly independent of ESR (Equivalent Series Resistance of the capacitor). With a 10 microfarad output capacitance, there is an 89° phase margin and nearly two decades of gain margin. This makes the circuit useful over almost any reasonable capacitive load. In addition, the push-pull amplifier design makes the circuit very responsive to steps in the load current.

Figure 5:
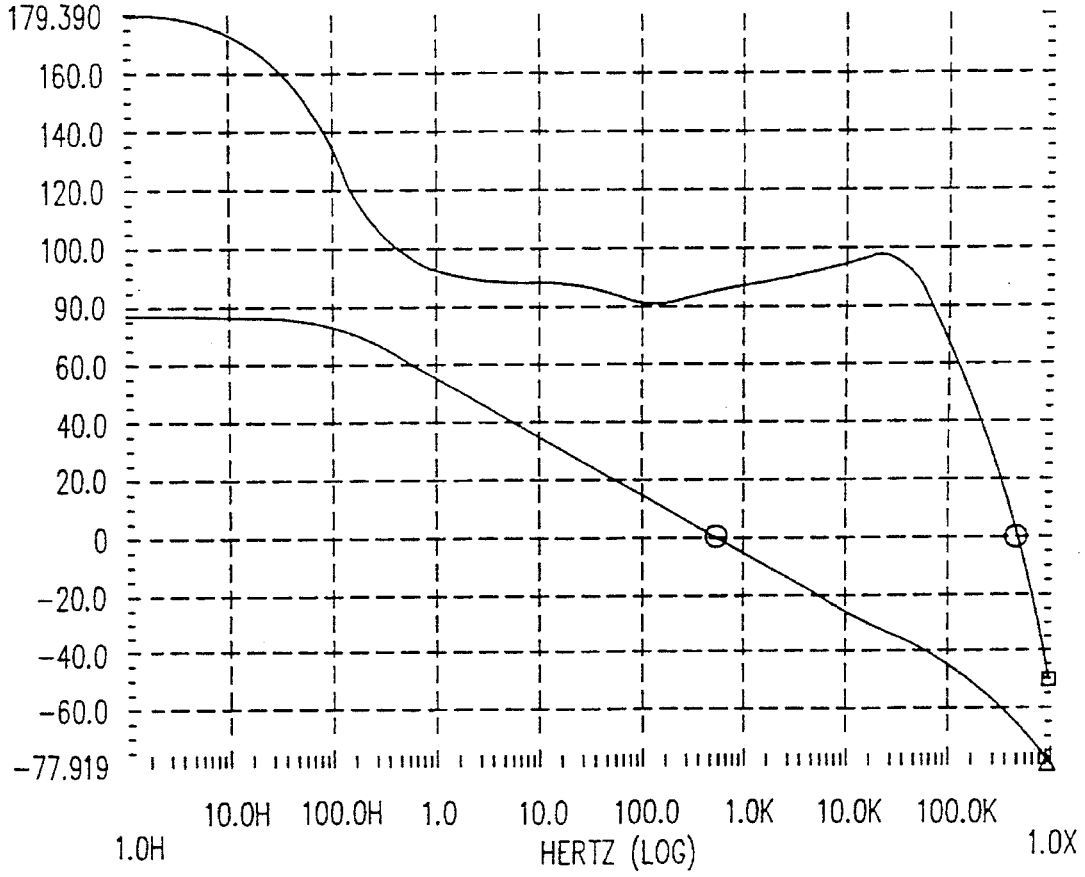
FIG. 5 is a Bode plot of the output amplifier stage illustrating its improved performance.

It can be seen from the Bode plot of FIG. 5 for the amplifier that the output has three decades of gain margin and 90 degrees of phase margin. This allows the regulator to be stable into a wide variation of capacitive loads. The low output impedance insures that step changes will not perturb the output voltage severely and the current compensation acts to limit overshoot.

The output stage was designed to be stable into capacitive loads from 0.1 μf to 100 μf and to be very insensitive to capacitor ESR. To be stable, the amplifier requires a few tens of milliohms of ESR.

Figure 6:
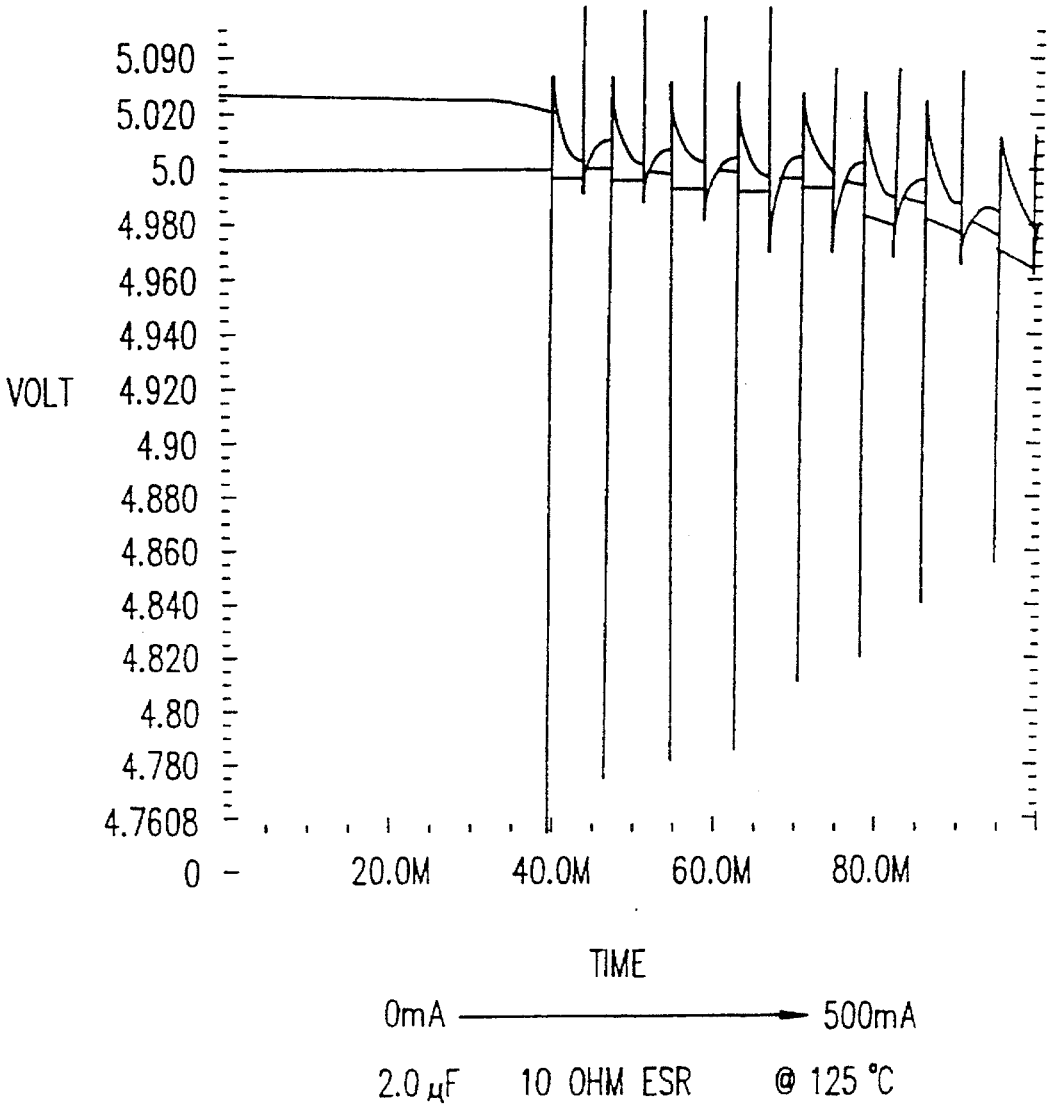
FIG. 6 illustrates the voltage regulator's response to output current steps.

The zero in the output impedance makes the circuit very responsive to current steps. FIG. 6 is a plot of the output voltage as current is ramped exponentially from near zero to 500 ma with positive going 100 ma current steps.

The load is a "worst case" type load with low capacitance and high ESR. The output capacitor is 2 μF and the ESR is 10 ohms. The ESR resistor should produce 1 volt steps. It is apparent that the excursions are small and fast due to the low output impedance and high frequency response of the output stage. The nominal output voltage steps is only 50 mV positive and −250 mV negative on the short spikes due to the ESR of the capacitor. A small parallel capacitor with low ESR should remove the fast spikes. It is important here to note the stability and lack of oscillation.

The band gap reference generator 20 in FIG. 2 will now be described. It is standard observation in the industry that the product of beta and Gummel number is constant for normal NPN transistors. This fact was used to generate a beta compensation circuit.

The three main sources of error in a band gap voltage reference are resistor sheet resistance, $V_{BE}$ variation, and resistor variation due to low spatial frequency geometric variations of photoresist and etch. The first two errors are related because the resistor is built from the base sheet implant. As the resistor sheet resistance decreases, the $V_{BE}$ will rise in a correlated fashion through variations in the Gummel number, $N_b$. The circuit of FIG. 7 makes the band gap reference independent of $V_{BE}$ differences due to process variations and relatively independent of temperature. The fundamental relationship utilized is the high degree of correlation between Gummel number and beta, such that the product of the Gummel number and beta is constant. Beta is assumed to be only a function of Gummel number. A term proportional to (kT/q) In beta is introduced into the band gap reference to cancel out the changes in implant dose which will shift the basic band gap compensation.

Figure 7:
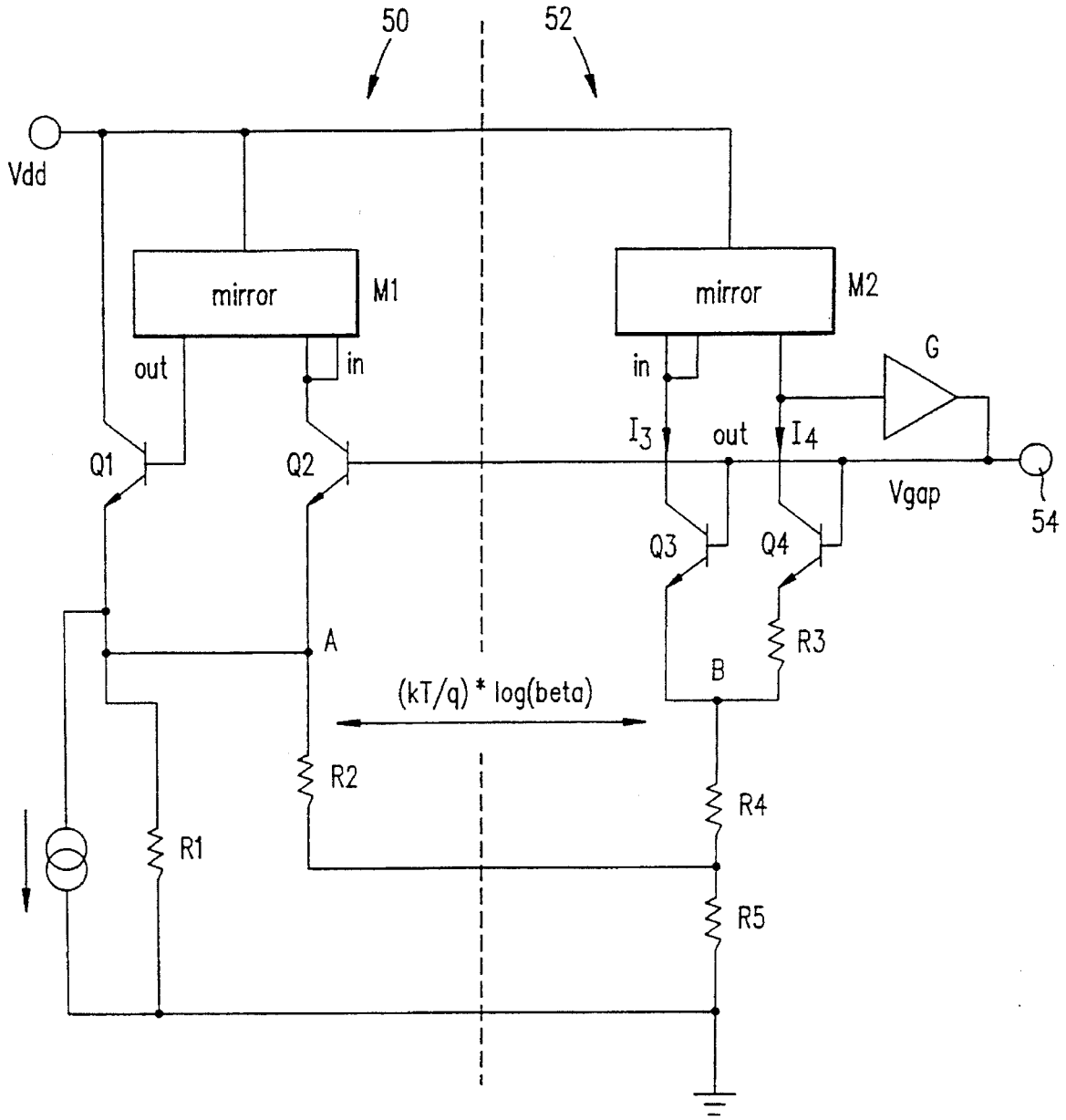
FIG. 7 is a simplified schematic diagram of the preferred embodiment band gap voltage reference regulator which introduces a beta compensation signal into the reference voltage generator output.
Figures 8, 8I:
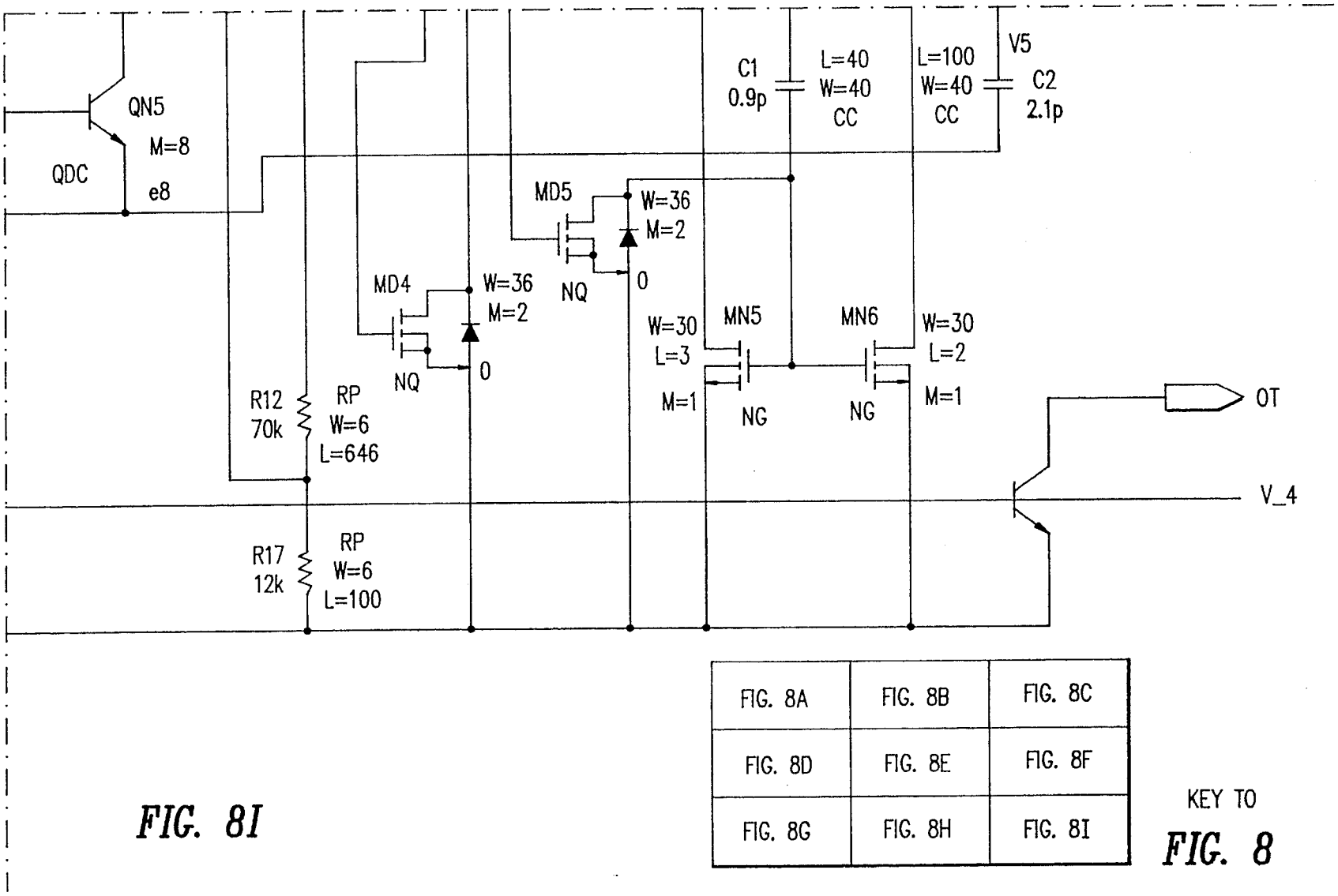
FIGS. 8A–8I are schematic diagrams of an actual circuit incorporating the band gap voltage reference generator of FIG. 7.
Figure 8A:
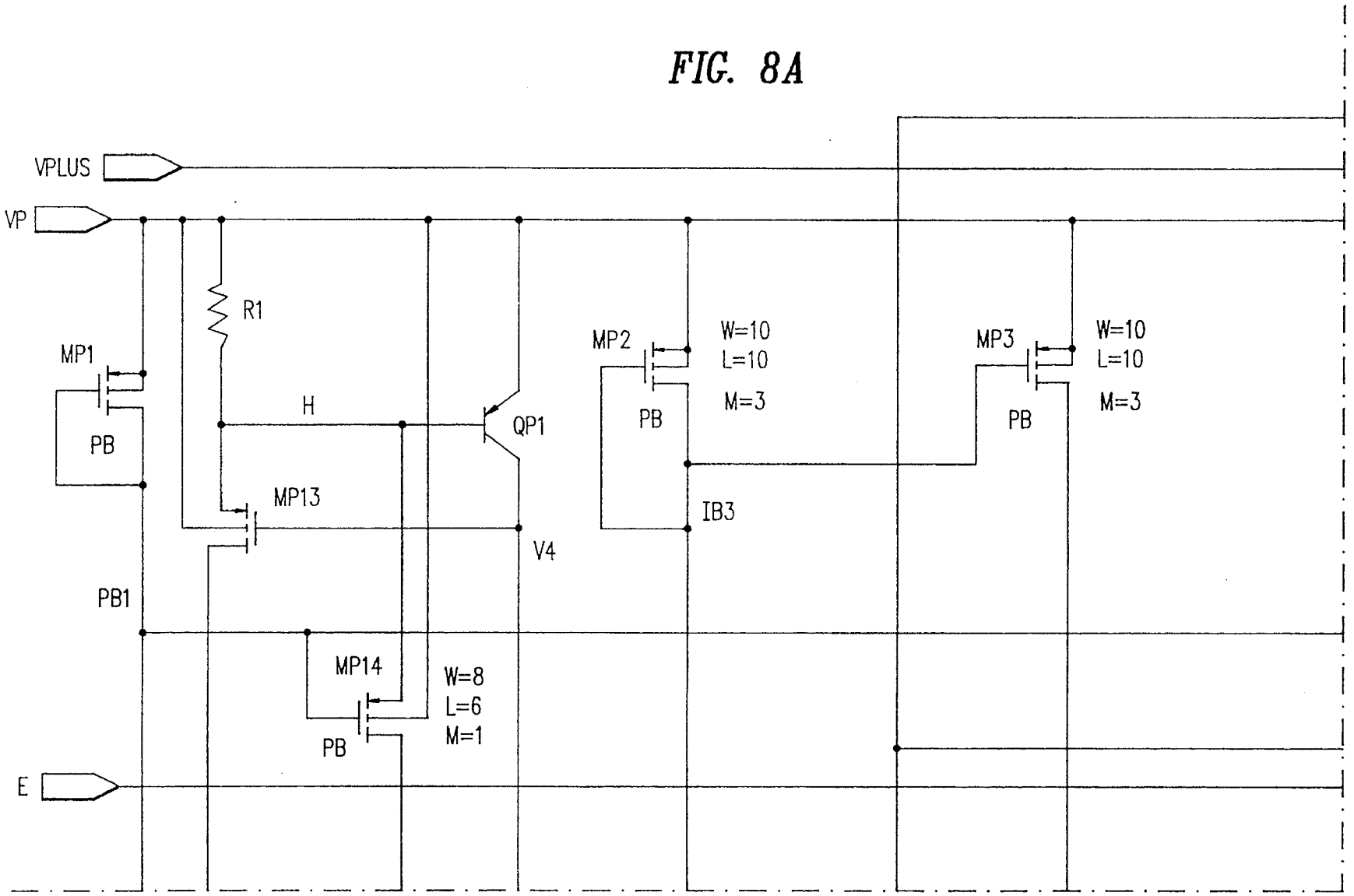
Figure 8B:
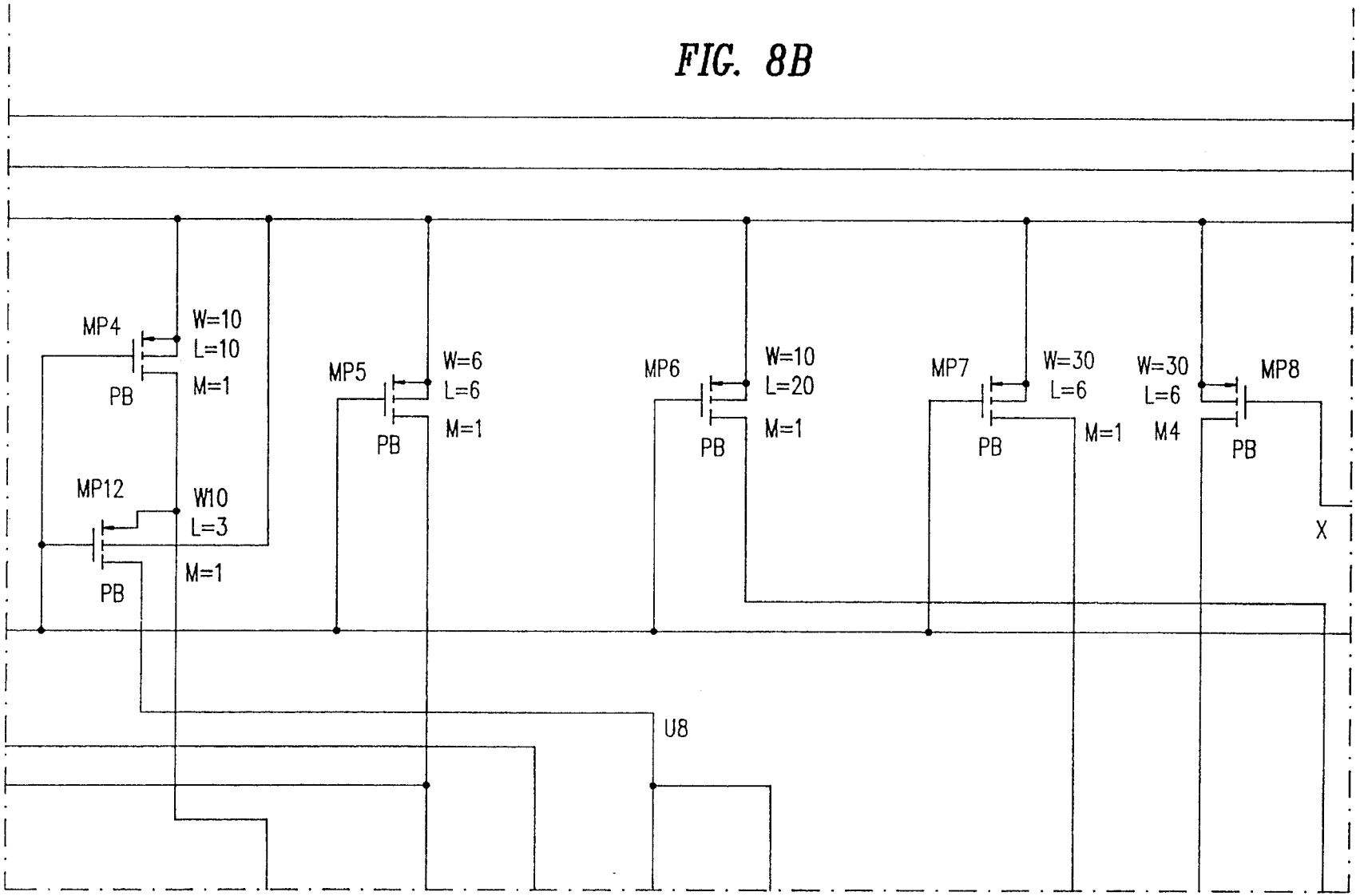
Figure 8C:
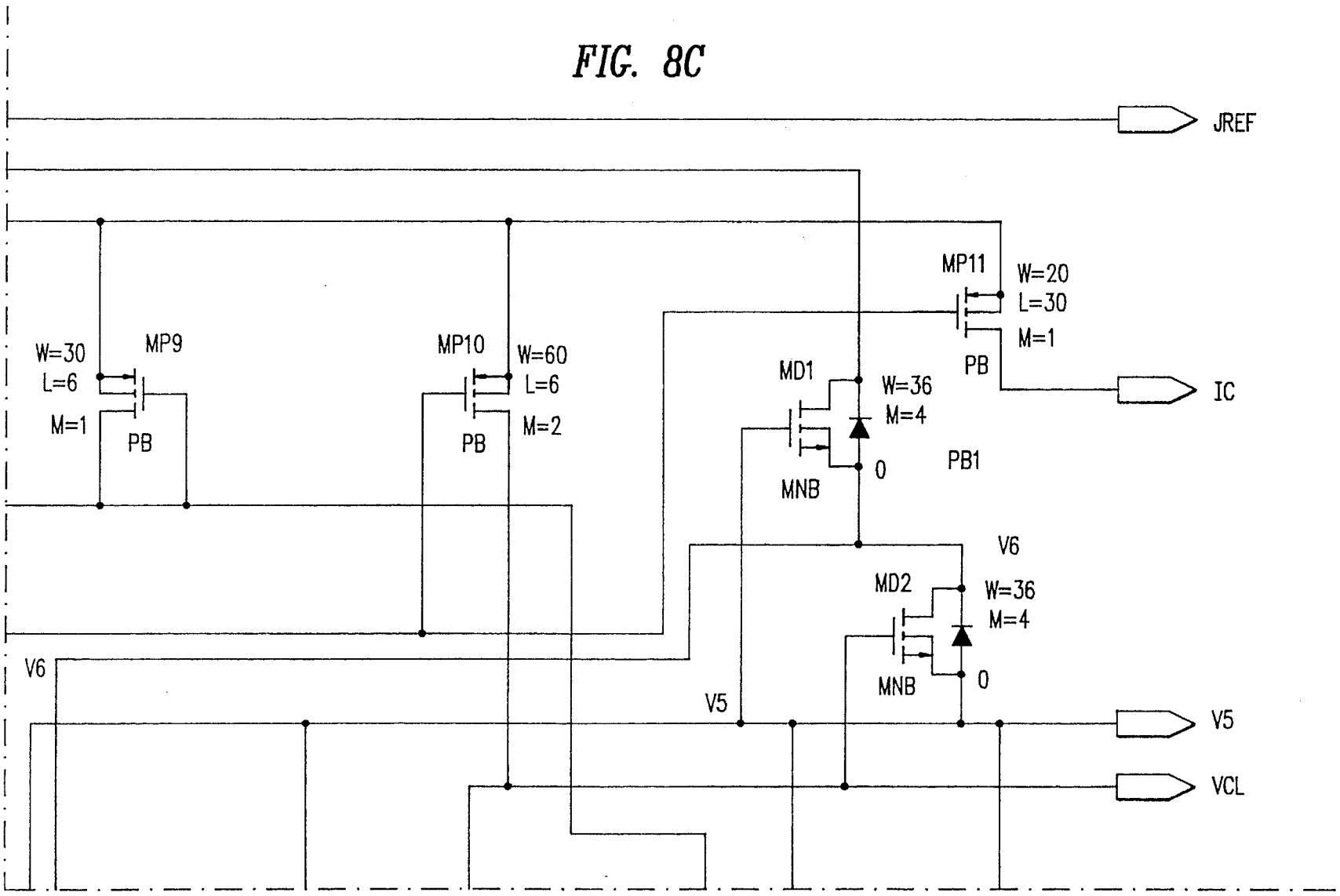
Figure 8D:
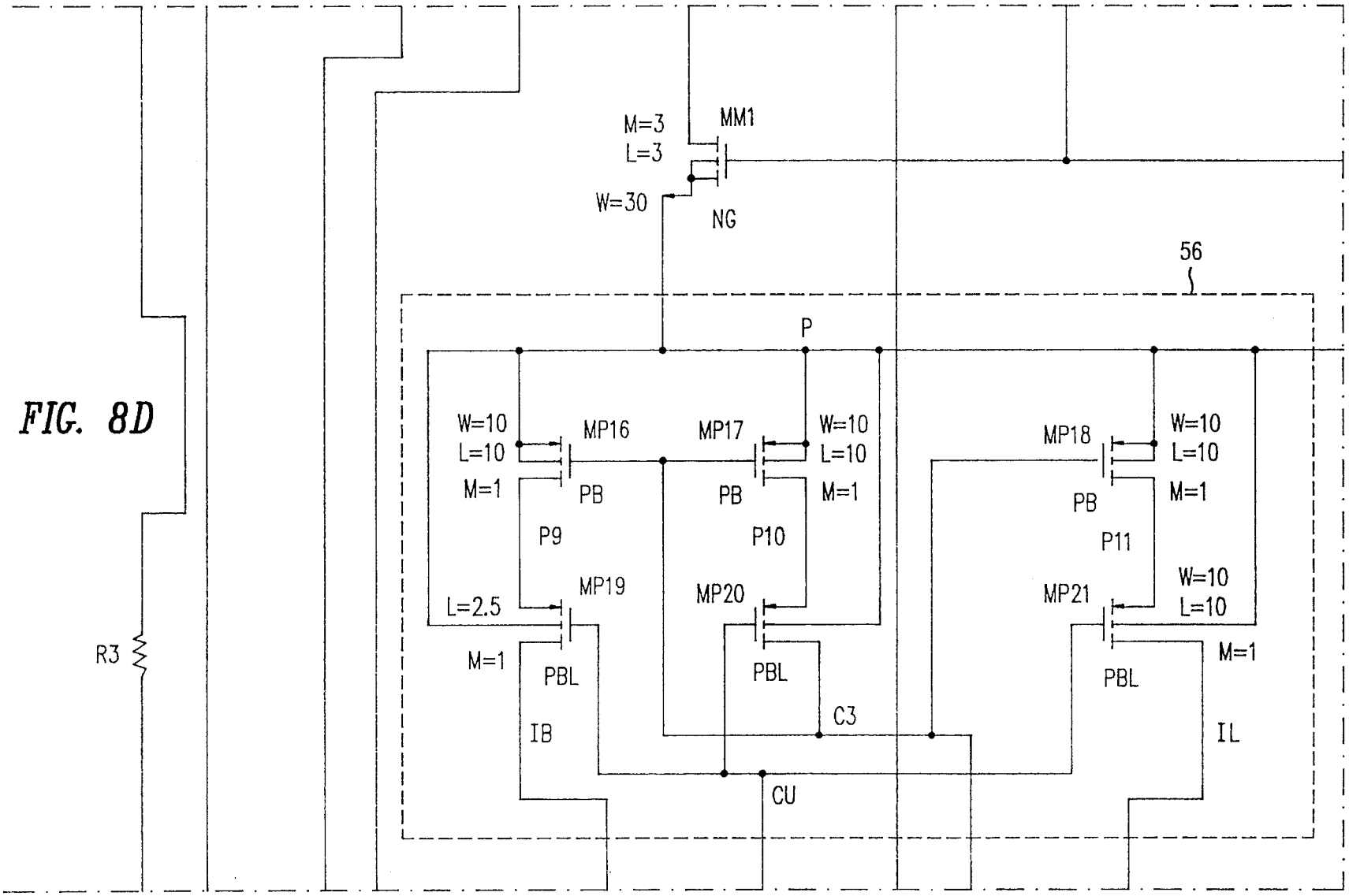
Figure 8E:
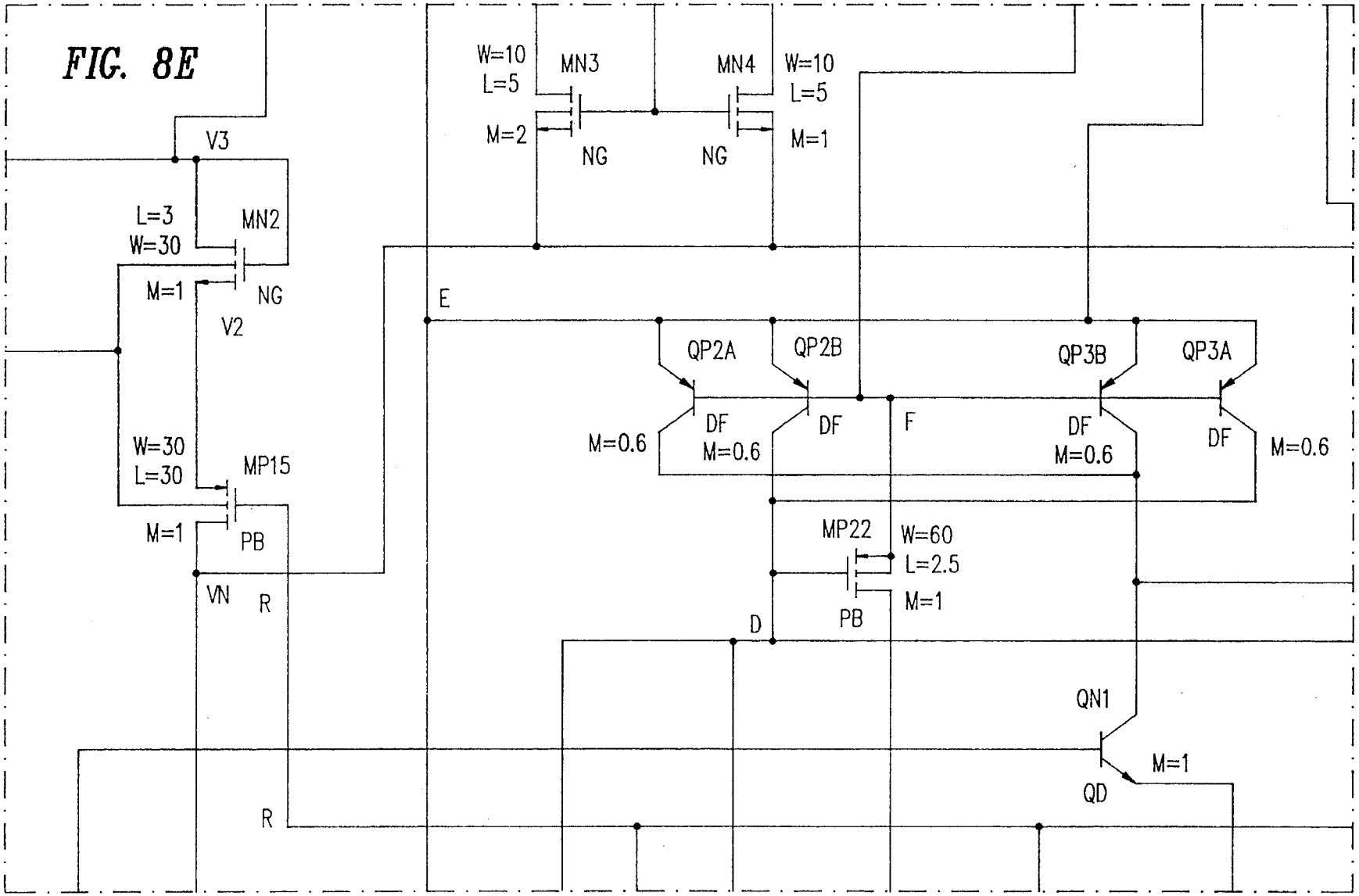
Figure 8F:
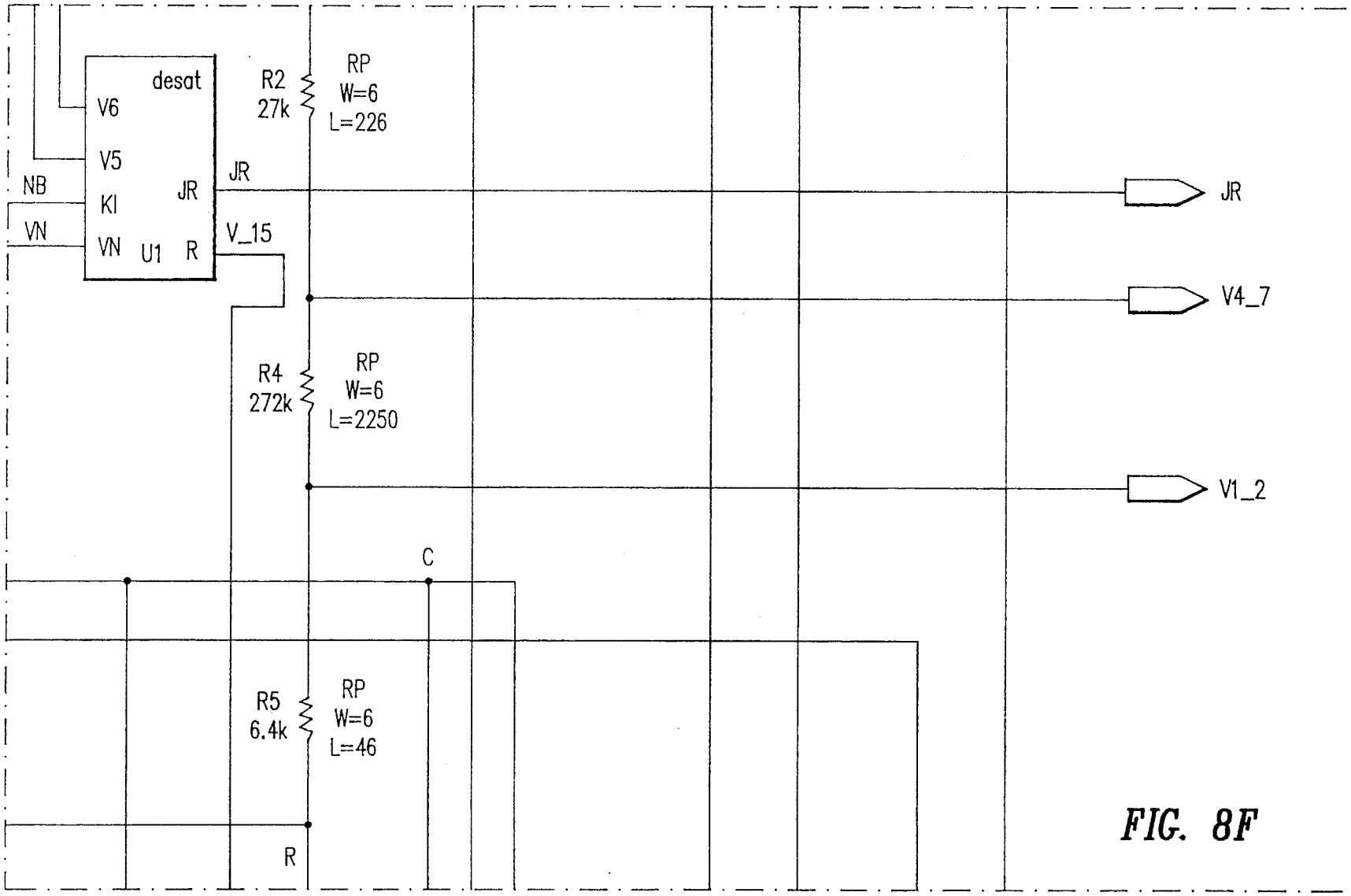
Figure 8G:
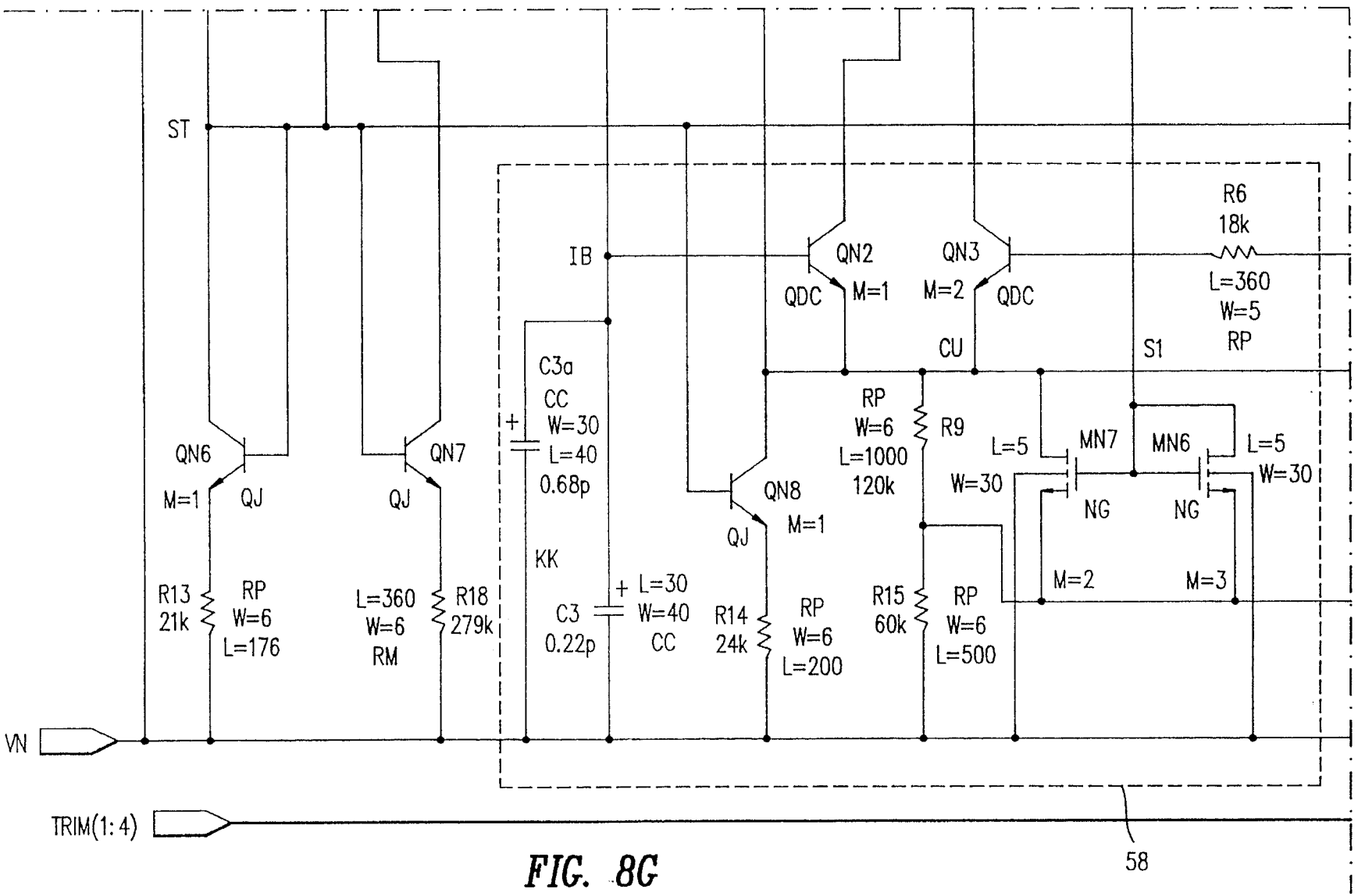
Figure 8H:
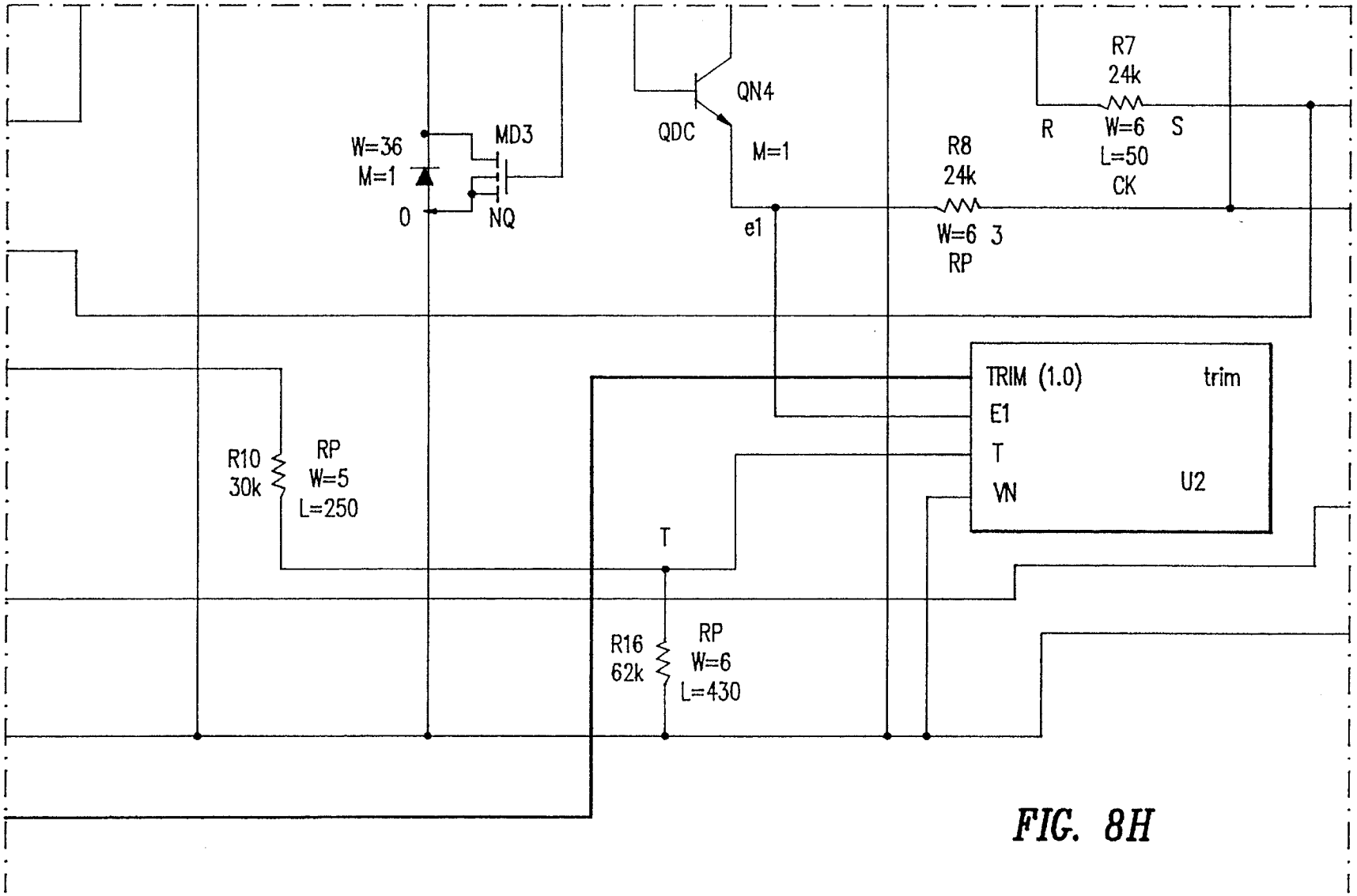

FIG. 7 illustrates a preferred embodiment of a circuit 50 for compensating the output of a band gap reference generator 52 for changes in the performance of generator 52 with process variations and temperature.

In the preferred embodiment, the output of generator 52 at node 54 is about 1.25 volts. This voltage is level shifted to 5 volts, using well known circuit techniques, for use as a voltage reference in the regulator of FIG. 2.

In FIG. 7, a voltage proportional to (kT/q) in beta appears between points A and B. A portion of this voltage is then added to the band gap voltage to cancel out variations in $V_{BE}$. Also, since the Gummel number is strongly correlated to the resistor sheet rho, errors in the resistor sheet rho can also be compensated by this beta correction circuit. The resulting band gap reference circuit produced only a few tenths of a millivolt variation from minus 50° C. to 150° C.

To compensate for low spatial frequency geometric variations, a resistor width variation was introduced. In the band gap resistor bridge, if resistor width increases, current density in the transistors will increase, causing an increasing $V_{BE}$. The resistor width variation reduces the gain of the resistor bridge to restore the band gap voltage.

More specifically, in the circuit of FIG. 7, M1 and M2 are current mirrors, which may be conventional. For example, a current mirror can consist of two transistors having their emitters or sources connected to VDD and their bases or gates coupled together. The current flowing through one transistor will thus be the same as the current flowing through the other transistor since they have identical $V_{BE}$ or $V_{GS}$ voltages.

The current through transistors Q3 and Q4 are equal. The bases of transistors Q3 and Q4 are connected together. The emitter area of transistor Q4 is formed to be eight times as large as the emitter area of transistor Q3. Therefore, the $V_{BE}$ of transistor Q4 will be less than the $V_{BE}$ of transistor Q3. This creates a voltage difference across resistor R3 equal to (kT/q) in ($I_3 8/I_4$) or (kT/q) ln 8. This delta $V_{BE}$ has a positive temperature coefficient, while the $V_{BE}$ of transistor Q3 has a negative coefficient (around −2 mV/° C.).

The positive temperature coefficient of the voltage across resistor R3 is selected so that the change in voltage at node B with temperature sets off the change in the $V_{BE}$ of transistor Q3 with temperature. As a result, the voltage at output terminal 54 will remain fairly constant over temperature.

The delta $V_{BE}$ is equal to $R_3 I_4$ and, therefore, $I_4=(kT/qR_3)$ ln 8. The output voltage at terminal 54 is equal to the $V_{BE}$ of Q3 plus $I_4(R_4+R_5)$, where the first term has a negative temperature coefficient and the second term has a positive temperature coefficient. For the best performance, the resistor values are chosen such that the output voltage is about 1.25 volts.

In the beta compensation circuit 50, the current in transistor Q1 is determined by the band gap voltage at output terminal 54 minus the $V_{BE}$ of transistor Q2 divided by the equivalent resistance to ground formed by R1, R2 and R5. (The current in R4 is also taken into account). The current mirror M1 forces the transistor Q2 collector current to operate at the transistor Q1 base current. Since base current is related to collector current by beta (i.e., beta=Ic/Ib), then the transistor Q2 collector current will be a function of beta. The voltage between the emitters of transistors Q2 and Q3 will be proportional to kT/q ln (beta).

The voltage at the emitter of transistor Q2 is divided by the resistor network comprising resistors R2 and R5 so that the change in beta of the compensation circuit 50 due to process and temperature variations will vary the voltage at node B in a manner opposite to the change in voltage at node B due to changes in beta of the band gap voltage reference circuit 52. Thus, the output voltage at terminal 54 will be more constant and predictable using compensation circuit 50.

Other switchable circuits may be used for introducing a voltage related to (kT/q) in (beta) into any band gap voltage reference to improve its performance.

Amplifier G forms a local feedback loop to raise the band gap output voltage at terminal 54 to the exact voltage (around 1.25 volts) where $I_3$ equals $I_4$.

FIGS. 8A–8I show the complete circuit of the band gap reference as implemented in the IC voltage regulator. The current mirror for M1 is within dashed lines 56 and consists of MOS transistors MP16 through MP20. The beta correction transistors are QN2 and QN3 within dashed lines 58. The band gap transistors are QN4 and QN5.

Figures 9, 9A, 9B:
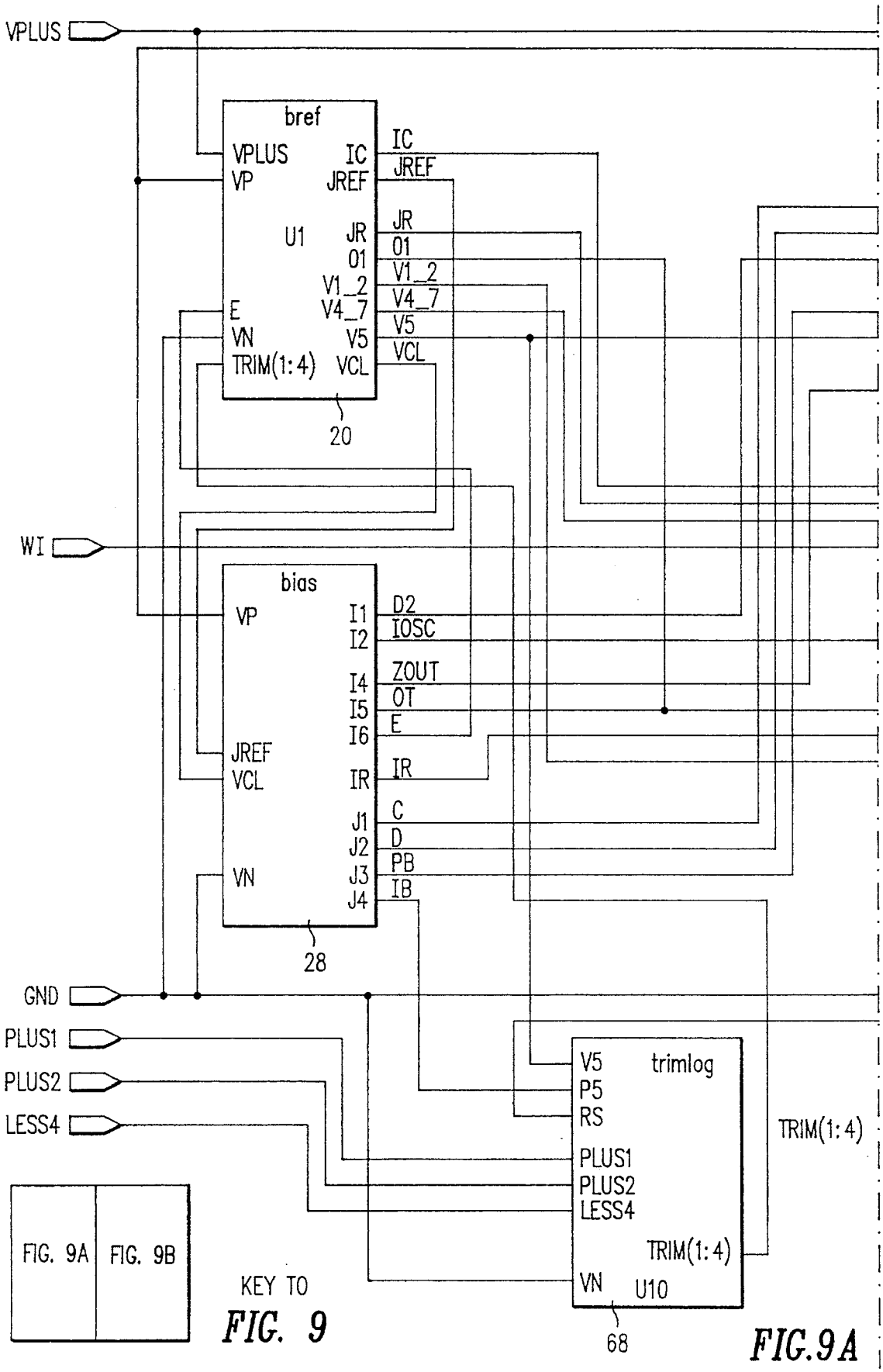
FIG. 9 and FIG. 9B are high level block diagrams of the various functional blocks and interconnections between these blocks in one embodiment of a voltage regulator.
Figure 9B:
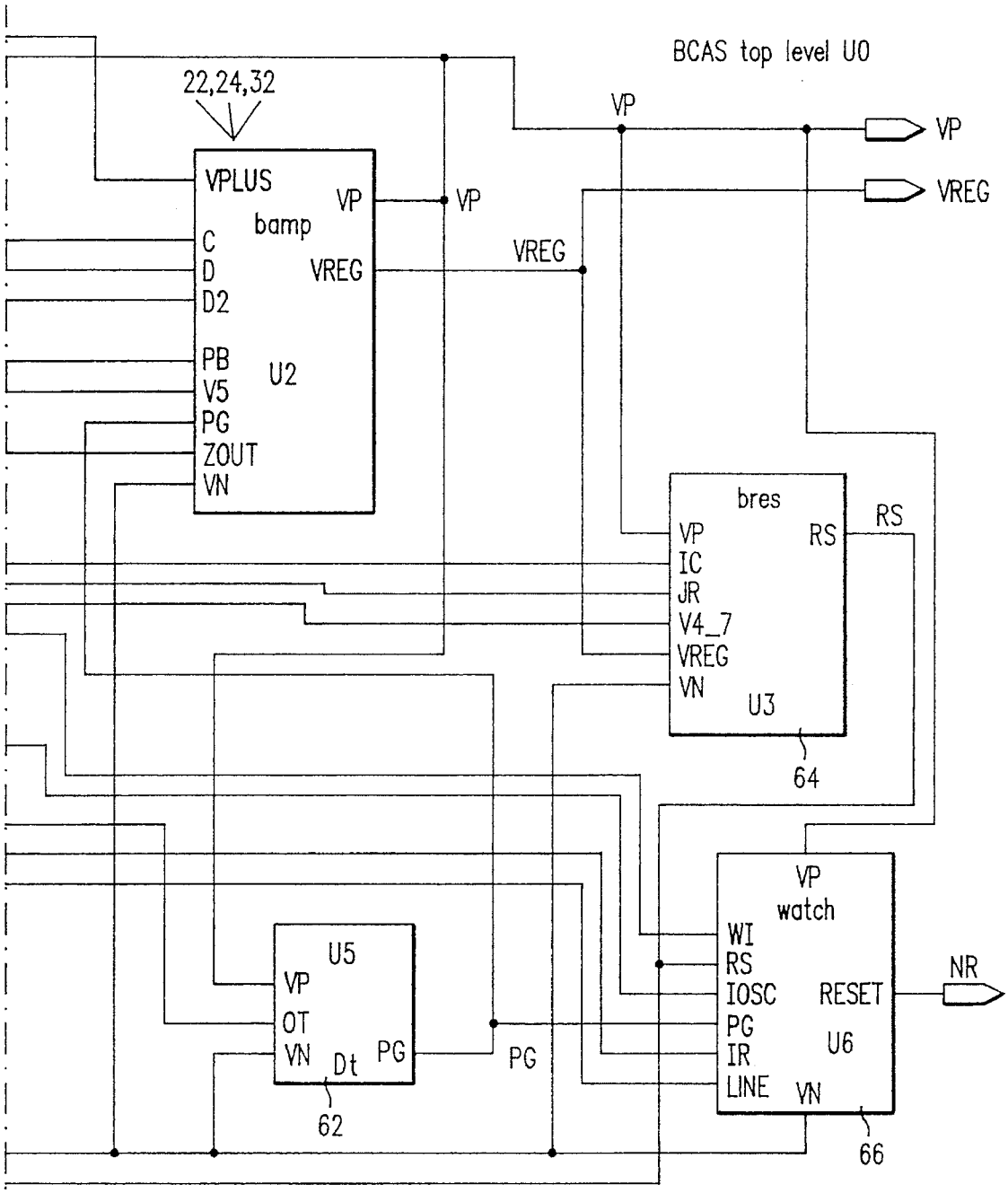

FIGS. 9A and 9B are high level block diagrams illustrating one embodiment of a voltage regulator incorporating the novel circuits described in detail herein. Shown is the reference voltage generator 20 and the combined error amplifier 22, output amplifier 24, and current detector 32.

Also shown is a control circuit 62 for controlling the on/off state of the PMOS transistor MP9 in FIG. 3.

An optional reset circuit 64 senses when the output voltage falls below the regulated output voltage, such as resulting from a loss in regulation by exceeding the current or thermal limit, or due to a low input voltage. In response to this lowering of the output voltage a reset signal is generated.

An optional watchdog circuit 66 detects a periodic pulse outputted by an external microprocessor to make sure the microprocessor is functioning. If the pulse is not detected, the watchdog circuit 66 outputs a reset signal which is ORed with the reset signal outputted by reset circuit 64.

Block 68 contains trim pads for trimming the reference voltage, as would be well known.

While particular embodiments of the present invention have been shown and described, it would be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A voltage generator comprising a band gap voltage generator and a compensation circuit for introducing a correction factor into said band gap voltage generator, said band gap voltage generator comprising:

a first bipolar transistor and a second bipolar transistor, said second bipolar transistor having a larger emitter area than the emitter area of said first bipolar transistor so that a base-emitter voltage drop ($V_{BE}$) of said second bipolar transistor will be smaller than the $V_{BE}$ of said first bipolar transistor given similar currents through said first bipolar transistor and said second bipolar transistor, a base of said first bipolar transistor being connected to a base of said second bipolar transistor, an emitter of said second bipolar transistor being connected to an emitter of said first bipolar transistor through a first resistance (R1), said emitter of said first bipolar transistor being connected to a first node, collectors of said first bipolar transistor and said second bipolar transistor being connected to a source of current, a current (I) through said first resistance R1 being equal to $$I=\Delta V_{BE}R1,$$

where $\Delta V_{BE}$ equals the difference between said $V_{BE}$ of said first bipolar transistor and the $V_{BE}$ of said second bipolar transistor, said a $V_{BE}$ having a positive temperature coefficient being used to set off a $V_{BE}$ with a negative temperature coefficient when generating a band gap output voltage at an output terminal of said band gap voltage generator, so that said band gap output voltage will remain substantially constant over temperature, said band gap output voltage being affected by non-linear variations in the characteristics of said first bipolar transistor and said second bipolar transistor;

said compensation circuit connected to said first node for coupling a first voltage generated by said compensation circuit to said first node related to $$(KT/q)\ ln\ (\text{beta}),$$

where K is Boltzman's constant, T is temperature, q is electronic charge, and beta is the current amplification factor of said first bipolar transistor, said first voltage offsetting said non linear variations in said first bipolar transistor and said second bipolar transistor so as to improve predictability of said band gap output voltage.

2. The voltage generator of claim 1 wherein said compensation circuit comprises:

a first voltage terminal for providing a first potential;

a second voltage terminal for providing a second potential;

a first current mirror electrically coupled to said first voltage terminal, said first current mirror providing substantially identical currents at a first output terminal and a second output terminal;

a third transistor having an emitter, a base and a collector, said collector of said third transistor being electrically coupled to said first voltage terminal, said base of said third transistor being electrically coupled to said first output terminal of said first current mirror, said emitter of said third transistor being electrically coupled to said first node;

a fourth transistor having an emitter, a base and a collector, said collector of said fourth transistor being electrically coupled to said second output terminal of said first current mirror, said emitter of said fourth transistor being electrically coupled to said first node, said base of said fourth transistor being electrically coupled to said base of said first bipolar transistor.

3. The voltage generator of claim 2 wherein said emitter of said third transistor is coupled to said second voltage terminal through a second resistance.

4. The voltage generator of claim 2 wherein said emitter of said fourth transistor is connected to said first node through a third resistance.

5. The voltage generator of claim 2 wherein said band gap voltage generator comprises:

a second current mirror electrically coupled to said first voltage terminal, said second current mirror providing substantially identical currents at a first output terminal and a second output terminal;

said collector of said first bipolar transistor being electrically coupled to said first output terminal of said second current mirror, said emitter of said first bipolar transistor being electrically coupled to said second voltage terminal through a forth resistance;

said collector of said second bipolar transistor being electrically coupled to said second output terminal of said second current mirror.

6. The voltage generator of claim 2, wherein said band gap output voltage is approximately 1.25 volts.

7. The voltage generator of claim 2 further comprising:

an amplifier having an input terminal electrically coupled to said collector of said second bipolar transistor, and an output terminal electrically coupled to said base of said second bipolar transistor.

8. The voltage generator of claim 2, wherein said first node of said band gap voltage generator is connected to said second voltage terminal through a second resistor and a third resistor electrically coupled in series with each other, and wherein said emitter of said fourth transistor is connected to a common connection of said second resistor and said third resistor through a fourth resistor.

9. The voltage generator of claim 1, wherein said band gap voltage generator is electrically coupled to an input of a comparator in a voltage regulator to supply a stable reference voltage for comparison to a feedback voltage.

10. A method of making a band gap output voltage of a band gap reference voltage generator less dependent on nonlinear variations in the characteristics of transistors forming the band gap reference voltage generator, said method comprising the steps of:

generating a first voltage at an output of a compensation circuit related to $$(KT/Q)\ ln\ (\text{beta}),$$

where K is Boltzman's constant, T is temperature, q is electronic charge, and beta is the current amplification factor of one or more transistors in said compensation circuit; and coupling said first voltage to a first node of said band gap reference voltage generator, said first voltage offsetting variations in said band gap output voltage due to said non-linear variations in the characteristics of transistors forming said band gap voltage generator.

* * * * *

UNITED STATES PATENT AND TRADEMARK OFFICE
CERTIFICATE OF CORRECTION

PATENT NO. : 5,596,265
DATED : January 21, 1997
INVENTOR(S) : Wrathall, Robert S.; Franck, Steven J.

It is certified that error appears in the above-identified patent and that said Letters Patent is hereby corrected as shown below:

Col. 2, line 16
Delete "in" and insert --In--.

Col. 2, line 37
Delete ":".

Col. 3, line 10
Delete "9" and insert --9A--.

Signed and Sealed this
Twelfth Day of August, 1997

Bruce Lehman

*Attest:*

BRUCE LEHMAN

*Attesting Officer*

*Commissioner of Patents and Trademarks*